US007789036B2

(12) United States Patent
Lien

(10) Patent No.: US 7,789,036 B2
(45) Date of Patent: Sep. 7, 2010

(54) COMPACT GLAZING MACHINE

(76) Inventor: Yuan-Yu Lien, 1F., No. 1, Alley 45, Lane 20, Dongli Rd., Dali City, Taichung County 412 (TW)

( * ) Notice: Subject to any disclaimer, the term of this patent is extended or adjusted under 35 U.S.C. 154(b) by 864 days.

(21) Appl. No.: 11/678,709

(22) Filed: Feb. 26, 2007

(65) Prior Publication Data

US 2008/0202411 A1 Aug. 28, 2008

(51) Int. Cl.
*B05C 1/08* (2006.01)

(52) U.S. Cl. ..... 118/46; 118/249; 118/261; 118/62

(58) Field of Classification Search ..... 118/46, 118/249, 259, 261, 62, 63; 101/118, 119, 101/120; 427/428.12, 428.14, 428.15, 428.17, 427/348
See application file for complete search history.

(56) References Cited

U.S. PATENT DOCUMENTS 3,861,351 A * 1/1975 Bonwit et al. ..... 118/685
4,397,258 A * 8/1983 Dremel ..... 118/50
5,667,589 A * 9/1997 Mailander ..... 118/261
6,074,704 A * 6/2000 Le Riche et al. ..... 427/207.1

* cited by examiner

*Primary Examiner*—Laura Edwards

(57) ABSTRACT

A glazing machine includes a pressure roller and a printing roller, and the glaze is supplied and fills the gap between the pressure roller and the printing roller. A support roller is located beneath the printing roller and rotates in a direction opposite to a rotation direction of the printing roller. A poster moves through a gap between the printing roller and the support roller so that the glaze is spread on the poster. A blowing unit has a nozzle which blows air flow toward the printing roller to separate the printing roller and the poster. A suction roller is located beside the support roller and sucks the poster after being glazed. A plurality of guide plates are located beside the suction roller such that a front edge of the poster is movably located on the guide plates.

7 Claims, 5 Drawing Sheets

COMPACT GLAZING MACHINE

FIELD OF THE INVENTION

The present invention relates to a compact glazing machine of an simple structure and is suitable for being cooperated with small printing machine.

BACKGROUND OF THE INVENTION

A conventional glazing machine generally occupies a lot of space and cannot be moved so that only large printing factors use them. Some of the small printing machine and inkjet printing machine equipped with latest programs so as to print high quality printing materials. However, the conventional glazing machine is expensive and bulky so that the individual users or the printing stores of smaller scale cannot afford the large glazing machine. If a small amount of posters are printed, the glazing process should still be done and that requires a lot of money due to the small amount.

The present invention intends to provide a compact glazing machine which occupies less space and includes a simple structure and is made at low cost.

SUMMARY OF THE INVENTION

The present invention relates to a glazing machine that comprises a pressure roller controlled by a first cylinder which moves the pressure roller toward a printing roller which is controlled by a second cylinder which moves the printing roller toward a support roller. A gap is defined between the pressure roller and the printing roller. A supply tube is located between the pressure roller and the printing roller so as to provide glaze to fill the gap, and the poster moves through a gap between the printing roller and the support roller. A scrap board is located beside a lower portion of the support roller so as to scrap the glaze from the support roller. A blowing unit has a nozzle which blows air flow toward the printing roller at an angle relative to a horizontal plane so as to separate the printing roller and the poster. A suction roller is located beside the support roller and includes a hollow inside. A plurality of holes are defined through a wall of the suction roller and the hollow inside forms a lower pressure area so as to suck the poster toward the suction roller. A plurality of guide plates are located beside the suction roller and a front edge of the poster is movably located on the guide palates. A power source drives the pressure roller, the printing roller and the support roller.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
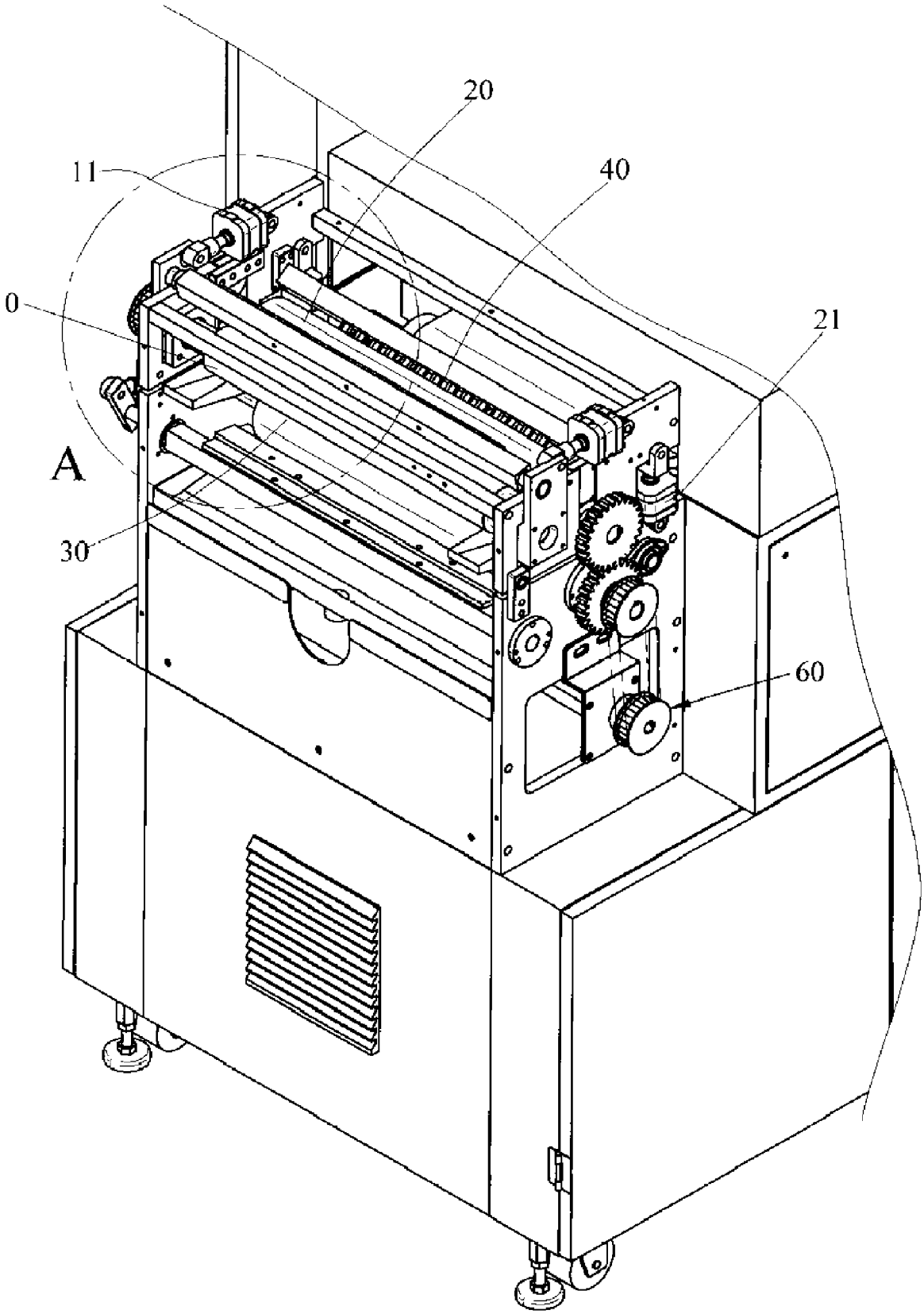
FIG. 1 is a perspective view to show the glazing machine of the present invention.
Figure 2:
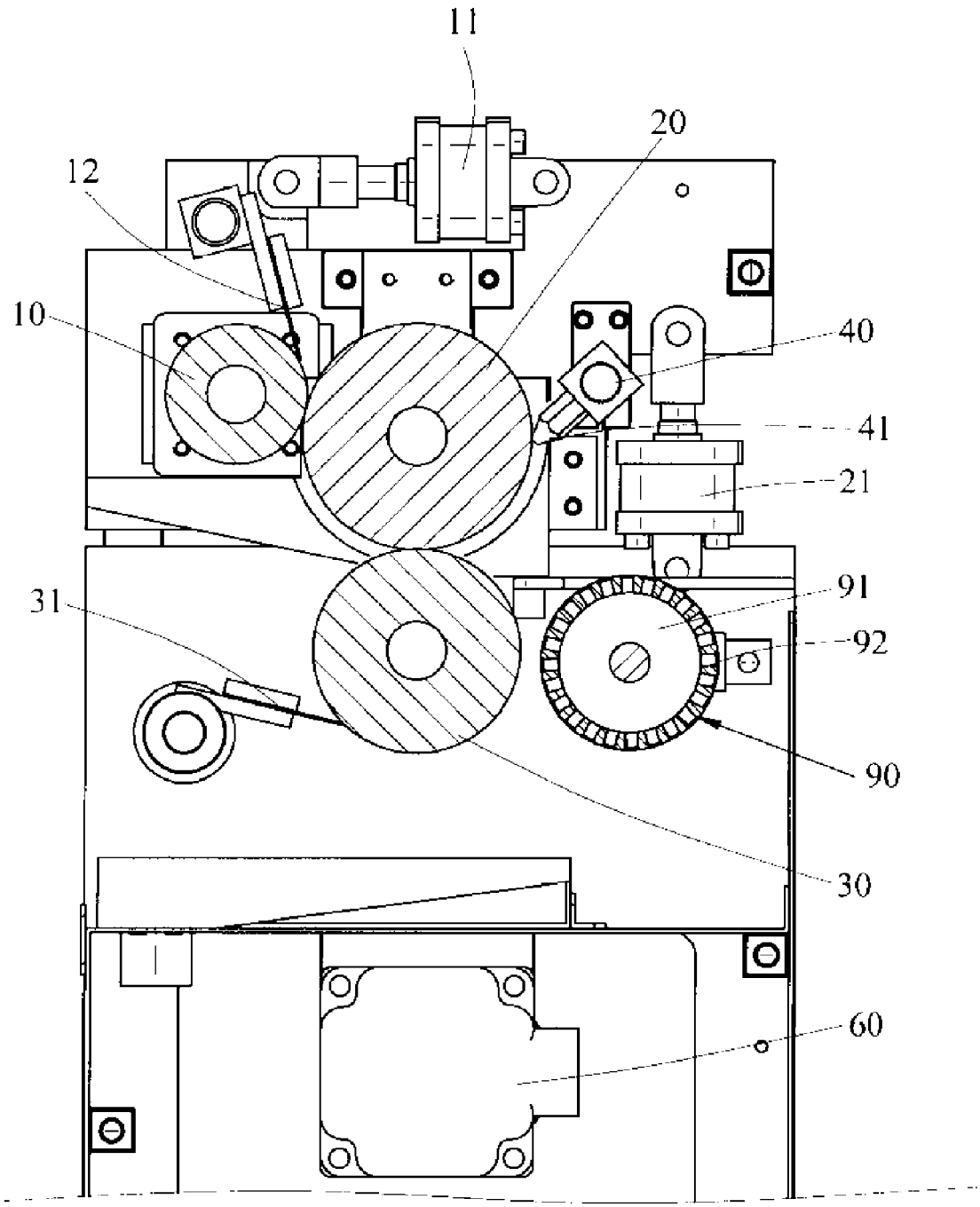
FIG. 2 shows the parts of the glazing machine of the present invention.
Figure 3:
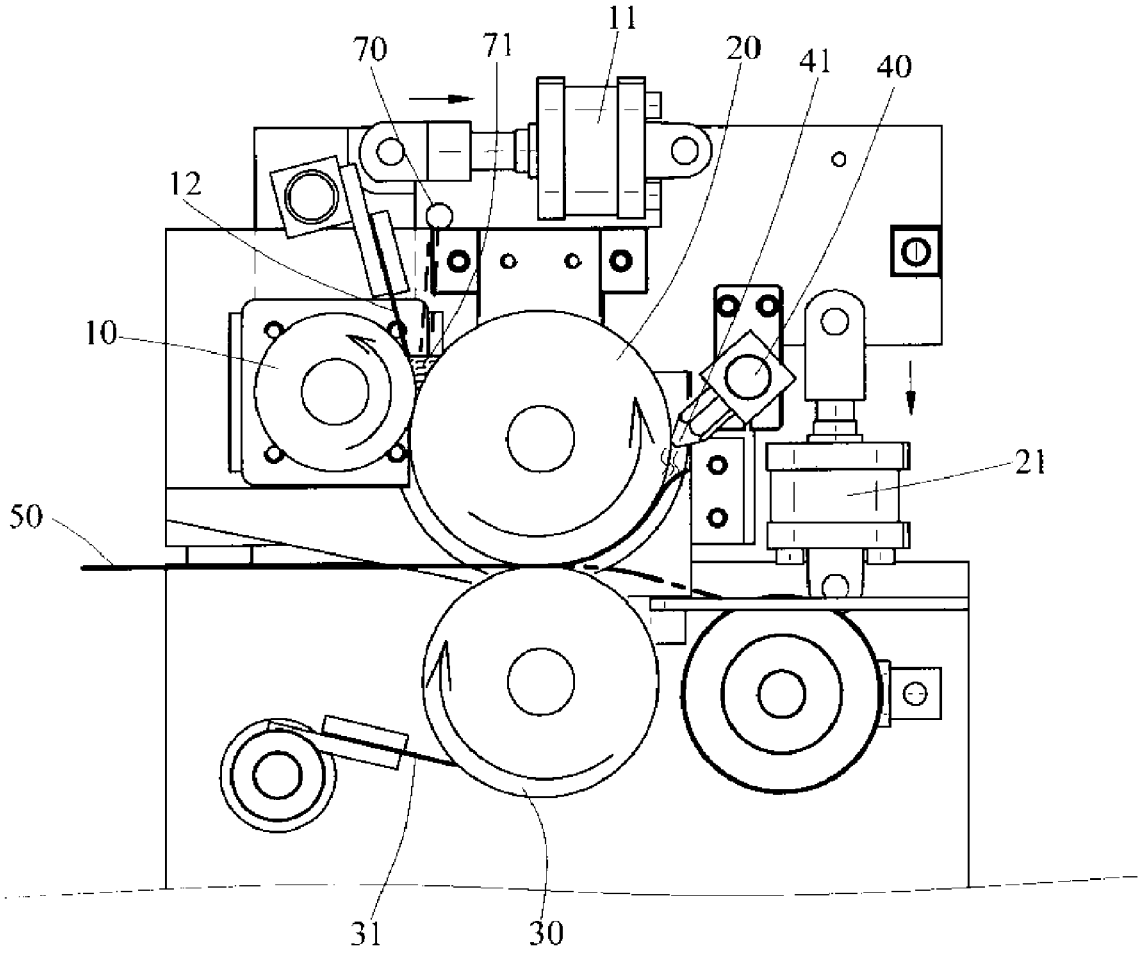
FIG. 3 shows the glaze is filled in the gap between the pressure roller and the printing roller, and the poster moves through between the printing roller and the support roller.
Figure 4:
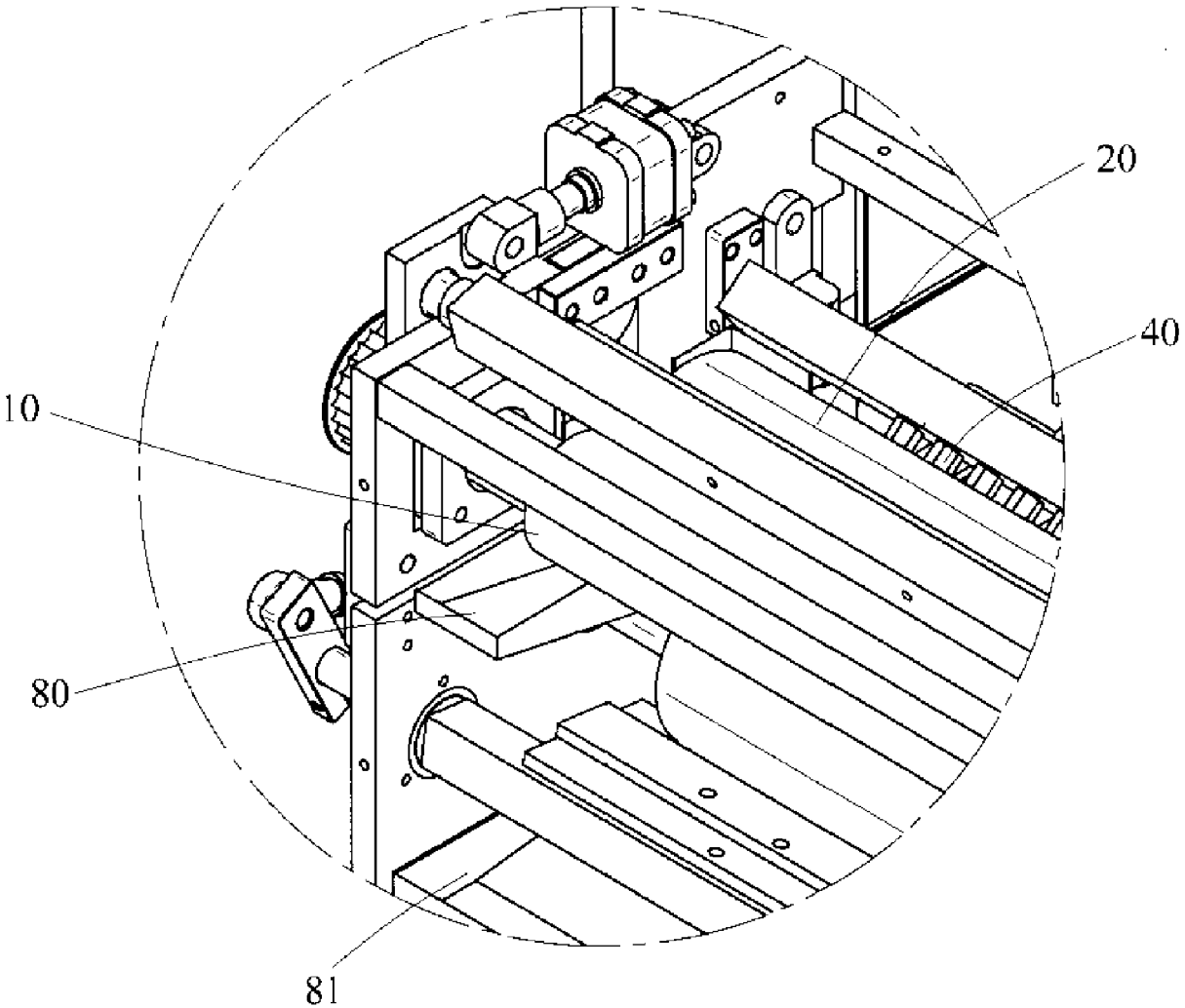
FIG. 4 shows two collection plates are located beneath the pressure roller and the support roller.
Figure 5:
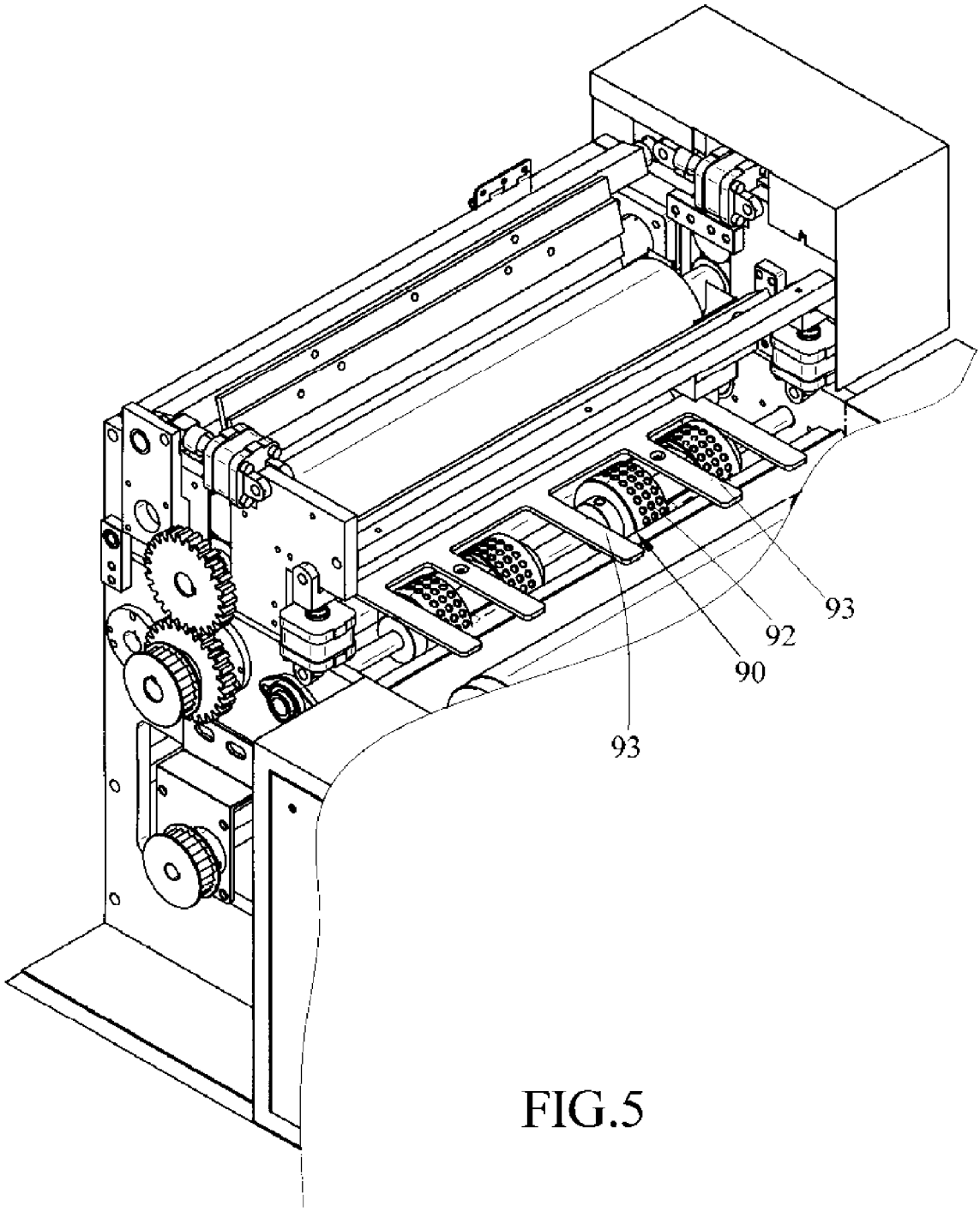
FIG. 5 shows guide plates are located beside the suction roller.

Referring to FIGS. 1 to 5, the glazing machine of the present invention comprises a metal pressure roller 10 which is controlled by a first cylinder 11, and a rubber-made printing roller 20 is connected with a second cylinder 21. A gap is defined between the pressure roller 10 and the printing roller 20. A supply tube 70 is located between the pressure roller 10 and the printing roller 20 so as to provide glaze 71 to fill the gap, and the glaze 71 will not drop through the gap due to the surface tension thereof. The pressure roller 10 and the printing roller 20 rotate in the same direction as shown in FIG. 3 and a scrap board 21 is located beside the pressure roller 10 so as to scrap the glaze 71 from the pressure roller 10. A collection plate 80 as shown in FIG. 4 is located beneath the pressure roller 10 so as to collect the glaze 71 scraped by the scrap board 21.

A metal support roller 30 is located beneath the printing roller 20 and the printing roller 20 is moved toward the support roller 30 by the second cylinder 21, The support roller 30 rotates in a direction opposite to a rotation direction of the printing roller 20. Another scrap board 31 is located beside a lower portion of the support roller 30 so as to scrap the glaze 71 from the support roller 30.

A poster 50 moves through a gap between the printing roller 20 and the support roller 30, a first side of the poster 50 is in contact with the printing roller 20 so that the glaze 71 on the printing roller 20 spreads on the first side of the poster 50, and a second side of the poster 50 is in contact with the support roller 30 so that the poster 50 is driven by the printing roller 20 and the support roller 30. The printing roller 20 is pushed by the second cylinder 21 to press on the support roller 30 so as to spread a consistent thickness of the glaze 71 on the poster 50.

It is noted that the lower portion of the support roller 30 does not have the glaze 71 attached thereto so that the second side of the poster 50 is not spread with the glaze 71. Another collection plate 81 is located beneath the support roller 30 so as to collect the glaze 71 scraped from the support roller 30.

A power source drives the pressure roller 10, the printing roller 20 and the support roller 30, wherein the rotational speed of the pressure roller 10 is controlled by a motor 60 of the power source. The faster the rotational speed of the pressure roller 10 is, the thinner the thick of the glaze 71 is attached to the printing roller 20.

A blowing unit 40 has a nozzle 41 which blows air flow toward the printing roller 20 at an angle relative to a horizontal plane so as to separate the printing roller 20 and the poster 50. A metal suction roller 90 is located beside the support roller 30 and has a hollow inside 91. A plurality of holes 92 are defined through a wall of the suction roller 90 and the hollow inside 91 forms a lower pressure area so as to suck the poster 50 toward the suction roller 90. A plurality of guide plates 93 are located beside the suction roller 90 and a front edge of the poster 50 movably located on the guide palates 93 rather being attached with the suction roller 90.

While we have shown and described the embodiment in accordance with the present invention, it should be clear to those skilled in the art that further embodiments may be made without departing from the scope of the present invention.

What is claimed is:

1. A glazing machine comprising:

a pressure roller connected with a first cylinder;

a printing roller connected with a second cylinder, a gap defined between the pressure roller and the printing roller, a supply tube located between the pressure roller and the printing roller so as to provide glaze to fill the gap;

a support roller located beneath the printing roller and rotating in a direction opposite to a rotation direction of the printing roller, a scrap board located beside a lower portion of the support roller so as to scrap the glaze from the support roller, a poster moving through a gap between the printing roller and the support roller, a first side of the poster being in contact with the printing roller and a second side of the poster being in contact with the support roller;

a blowing unit having a nozzle which blows air flow toward the printing roller at an angle relative to a horizontal plane so as to separate the printing roller and the poster;

a suction roller located beside the support roller and having a hollow inside, a plurality of holes defined through a wall of the suction roller and the hollow inside forming a lower pressure area so as to suck the poster toward the suction roller, a plurality of guide plates located beside the suction roller and a front edge of the poster movably located on the guide plates, and a power source driving the pressure roller, the printing roller and the support roller.

2. The glazing machine as claimed in claim 1, wherein another scrap board is located beside the pressure roller so as to scrap the glaze from the pressure roller.

3. The glazing machine as claimed in claim 1, wherein the pressure roller is made by metal.

4. The glazing machine as claimed in claim 1, wherein the support roller is made by metal.

5. The glazing machine as claimed in claim 1, wherein two collection plates are respectively located beneath the pressure roller and the support roller.

6. The glazing machine as claimed in claim 1, wherein the power source includes a motor which controls a rotational speed of the pressure roller.

7. The glazing machine as claimed in claim 1, wherein the suction roller is made by metal.

* * * * *